US011313171B2

(12) United States Patent
Lee

(10) Patent No.: US 11,313,171 B2
(45) Date of Patent: Apr. 26, 2022

(54) DOOR GUIDE FRAME OF DETACHABLE SEGMENT STRUCTURE FOR SLIDING WINDOWS AND DOORS

(71) Applicant: FILOBE CO., LTD., Daegu (KR)

(72) Inventor: Kwang-Seog Lee, Daegu (KR)

(73) Assignee: FILOBE CO., LTD., Daegu (KR)

( * ) Notice: Subject to any disclaimer, the term of this patent is extended or adjusted under 35 U.S.C. 154(b) by 78 days.

(21) Appl. No.: 16/345,827

(22) PCT Filed: Oct. 28, 2017

(86) PCT No.: PCT/KR2017/012069
§ 371 (c)(1),
(2) Date: Apr. 29, 2019

(87) PCT Pub. No.: WO2018/080256
PCT Pub. Date: May 3, 2018

(65) Prior Publication Data

US 2020/0056419 A1 Feb. 20, 2020

(30) Foreign Application Priority Data

Oct. 28, 2016 (KR) ..... 10-2016-0142377

(51) Int. Cl.
*E06B 3/46* (2006.01)
*E05D 15/06* (2006.01)
(Continued)

(52) U.S. Cl.
CPC ..... *E06B 3/46* (2013.01); *E05D 15/0621* (2013.01); *E06B 3/26347* (2013.01);
(Continued)

(58) Field of Classification Search
CPC ..... E06B 3/46; E06B 3/26347; E06B 3/4609; E06B 9/52; E05D 15/0621;
(Continued)

(56) References Cited

U.S. PATENT DOCUMENTS 4,219,971 A * 9/1980 Mauroner ..... E05D 15/08 49/372
4,599,836 A * 7/1986 Melcher ..... E06B 5/003 49/62

(Continued)

*Primary Examiner* — Justin B Rephann
(74) *Attorney, Agent, or Firm* — Neifeld IP Law, PLLC

(57) ABSTRACT

The present invention relates to a door guide frame of a detachable segment structure for sliding windows and doors, in which in order to improve heat insulating performance of the door guide frame, the door guide frame is divided into an outer body portion and an inner body portion and a thermal break is disposed therebetween, and even when a second pocket guide segment accommodated in the inner side surface of the inner body portion and a third pocket guide segment accommodated in the inner side surface of the outer body portion are separated from an upper cap region of an aluminum material and have a lower leg region formed of a thermal break material, a supporting means capable of providing a good supporting force for the lower leg region formed of such thermal break material is provided without affecting the heat insulating performance of the door guide frame.

5 Claims, 13 Drawing Sheets

(51) Int. Cl.
*E06B 3/263* (2006.01)
*E06B 9/52* (2006.01)

(52) U.S. Cl.
CPC ..... *E06B 3/4609* (2013.01); *E06B 9/52* (2013.01); *E05Y 2900/132* (2013.01); *E05Y 2900/148* (2013.01)

(58) Field of Classification Search
CPC ..... E05D 15/0665; E05D 15/0686; E05Y 2900/132; E05Y 2900/148
See application file for complete search history.

(56) References Cited

U.S. PATENT DOCUMENTS

| | | | | |
|---|---|---|---|---|
| 5,884,361 | A * | 3/1999 | Richardson | E05D 15/0665 16/100 |
| 7,555,871 | B1 * | 7/2009 | Neal | E05D 15/0621 49/409 |
| 8,739,481 | B2 * | 6/2014 | Kim | E06B 3/4636 52/204.6 |
| 9,103,159 | B2 * | 8/2015 | Kim | E06B 7/232 |
| 9,453,360 | B2 * | 9/2016 | Kim | E06B 3/02 |
| 9,512,656 | B2 * | 12/2016 | Lee | E05D 15/0621 |
| 10,808,441 | B2 * | 10/2020 | Fontijn | E06B 3/42 |
| 2006/0086052 | A1 * | 4/2006 | Petta | B29C 48/09 49/404 |
| 2008/0190030 | A1 * | 8/2008 | Cheon | E06B 3/4609 49/425 |
| 2010/0242365 | A1 * | 9/2010 | Langner | E05D 15/0686 49/130 |
| 2012/0005975 | A1 * | 1/2012 | Kim | E06B 7/26 52/209 |

* cited by examiner

DOOR GUIDE FRAME OF DETACHABLE SEGMENT STRUCTURE FOR SLIDING WINDOWS AND DOORS

CROSS REFERENCE TO RELATED APPLICATIONS

This application is a 371 National Stage Entry of PCT/KR2017/012069, filed Oct. 28, 2017, and PCT/KR2017/012069 claims priority to Korean Application 10-2016-0142377, filed Oct. 28, 2016. The contents of Korean Application 10-2016-0142377, filed Oct. 28, 2016, is incorporated by reference in its entirety.

TECHNICAL FIELD

The present invention relates to a door guide frame of detachable segment structure for guiding the sliding movement of a roller device which supports a sliding window and provides a sliding opening/closing operation and, more particularly, to a sliding window installation structure which is capable of: stably supporting and moving a sliding window or a horizontal sliding window (hereinafter, generally referred to as a "sliding window") on a bottom surface and a top surface on which the sliding window is installed; reducing an installation space by minimizing the size of a door guide frame and a roller device for supporting a heavy sliding window, thereby obtaining a wider open view when applied to a window; and employing a structure comprising a door guide frame of detachable segment structure which prevents a door guide rail from protruding upward from the bottom surface of a window frame so as to prevent occurrence of a passage obstacle which may be caused when the door guide rail protrudes on a moving passage while the window is opened, as well as to provide a good aesthetic appearance, thereby providing excellent applicability to various fields.

Background Art (Prior Art)

The applicant of the present application has proposed an invention disclosed in Korean Patent Application No. 10-2012-0047789 (filed on May 26, 2012) with respect to a sliding window installation structure including a door guide frame of such a separable and detachable segment structure. This Korean patent application has been disclosed in Korean Patent Laid-Open Publication No. 10-2013-0124444 (published on Nov. 14, 2013) and Korean Patent Publication No. 10-1367835 (issued on Mar. 3, 2014) It has also been published as WIPO Open Publication WO2013/168943A1 (published Nov. 14, 2014) and US Patent Application Laid-Open No. 2015-0121764 A1 (published May 7, 2015).

In the sliding window installation structure according to the prior art of the applicant of the present application, as shown in FIGS. 1 to 4 attached herewith, there is shown a door guide frame 100 for guiding a sliding window 400 at the inner and outer sides (front side and back side/inner and outer surfaces) of the sliding window 400, in which a pocket guide 130 is detachably attached to a main body portion 120 of the door guide frame 100. The pocket guide 130 includes a pocket guide segment (130; 130ⓐ or 130ⓑ; 130-1, 130-2, 130-3, and 130-4) detachable from the main body portion 120 of the door guide frame 100. Therefore, there is shown the door guide frame 100 having a structure in which the pocket guide segments (130; 130ⓐ or 130ⓑ) are detachably and continuously installed on both inner and outer surfaces of the sliding window 400 along a moving direction of a roller guide rail 110. However, an aluminum material can be generally used as a basic material for providing the door guide frame 100 having a detachable segment structure that forms such a structure. In the case of such an aluminum material, as shown in the cross-sectional view of the operating state of FIGS. 1 to 4 and in a partially exploded perspective view of FIG. 2 (a perspective view at a B-B' broken line location of FIG. 4), it is more advantageous to employ a structure in which the main body portion 120 of the door guide frame 100 is divided into two portions of the inner side and the outer side of the window and a heat bridge blocking member 120*m* (thermal bridge breaker) is disposed in a middle portion between the two portions. Moreover, a leg region 130*m* may be preferably formed of a heat-transmission-blocking material separated from a remaining upper cap region 130*a* made of aluminum.

However, when the main body portion 120 of the door guide frame 100 is arranged into two parts of an outer main body portion 120-out and an inner main body portion 120-in while the heat bridge blocking member 120*m* is disposed in the middle of the two parts as shown in FIG. 5, four pocket guide segments (130: 130ⓐ or 130ⓑ; 130-1, 130-2, 130-3, and 130-4) should be detachably installed on the main body portion 120 of the door guide frame 100, i.e. on the base surfaces of the outer main body portion 120-out and the inner main body portion 120-in. To this end, a partition wall 121 is protruded and formed on both sides of the roller guide rail 110 along the moving direction of the roller guide rail 110 to form a receiving portion 122 into which the pocket guide segment 130 can be inserted. Thereby, a leg portion of a first pocket guide segment 130-1 is inserted into an inner side of the receiving portion 122 of the inner main body portion 120-in, a leg portion of a second pocket guide segment 130-2 is inserted into an outer side of the receiving portion 122 of the inner main body portion 120-in, a leg portion of a third pocket guide segment 130-3 is inserted into an inner side of the receiving portion 122 of the outer main body portion 120-out, and a leg portion of a fourth pocket guide segment 130-4 is received into an outer side of the receiving portion 122 of the outer main body portion 120-out, respectively.

FIGS. 6, 7 and 8 show an application example in which the structure shown in FIGS. 1 to 4 and 5 is designed and manufactured as an actual product. In this application example, not only the main body portion 120 of the door guide frame 100, but also a vertical guide frame 101 on both sides is also made to adopt a heat insulating structure in which an inner frame and an outer frame are connected to each other by a thermal bridge blocking member 101*m* disposed in the middle region between the inner frame and the outer frame, and in a vertical reinforcing member 420 having an enlarged section (a section having a thickness larger than a thickness of the glass) for compensating the lateral bending stiffness of the glass 410 is formed on both sides of a glass 410 constituting the sliding window 400, furthermore provides a specific difference in that a steel reinforcing plate 422 for reinforcing the rigidity is inserted into the inside of the vertical reinforcing member 420.

In the door guide frame of the separable and detachable segment structure for sliding windows according to the prior art described above, in the case of a first pocket guide segment 130-1 being accommodated in the inner side surface of the inner main body portion 120-in, and in the case of a fourth pocket guide segment 130-4 being accommodated in the outer surface of the outer main body portion 120-out, the entirety may be formed of an aluminum material (see FIG. 5), or only the leg portion thereof may be formed as a thermal bridge blocking member (see FIG. 6 and FIG. 7). These are housed in the receiving portion 122 of the main body portion 120 of the door guide frame 100 of the aluminum material with the two inner and outer leg portions at the lower portion to form a good supporting state as shown in the figure. On the other hand, as shown in FIG. 8, in the case of the second pocket guide segment 130-2 being accommodated in the outer surface of the inner main body portion 120-in and in the case of the third pocket guide segment 130-3 being accommodated in the inner surface of the outer main body portion 120-out, since the lower leg region 130*m*, formed by the heat bridge member being separated from the upper cap region 130*a* of the aluminum material, should be located on the heat bridge blocking member 120*m* connecting the inner main body portion 120-in and the outer main body portion 120-out of the main body portion 120 of the door guide frame 100, it is difficult to expect a good supporting force. Also, it is difficult to provide suitable fastening means (fitting engagement) to the thermal bridge blocking member 120*m* between them (making it difficult to form with the fitting engagement). Therefore, there is a high possibility that a mounting clearance is generated in a connecting part contact-K between the first pocket guide segment 130-2 and the third pocket guide segment 130-3, and if the first pocket guide segment 130-2 and the third pocket guide segment 130-3 are made with a little tolerance margin to reduce the possibility of such clearance, accordingly, it is difficult to install the other one in a state in which one of the two is installed first, and thus a poor installation condition such as the incline of the upper cap region 130*a* occurs.

Further, when such a poor workability is caused, friction noise due to inadequate excessive friction with the accessory guide rollers 457 provided on the side of the roller member 450 under the sliding window 400 may occur.

DETAILED DESCRIPTION OF THE INVENTION

Technical Problem

The present invention has been made in order to solve the problems in the prior art and a technical object of the present invention is to provide a means for providing a good supporting force for a lower leg region formed of such a heat bridge blocking member without damaging the heat insulating performance of the frame, even when the second pocket guide segment accommodated in the outer side surface of the inner main body portion and the third pocket guide segment accommodated in the inner side surface of the outer main body portion is separated from the upper cap region of the aluminum material and has the lower leg region formed of the heat bridge blocking member, in order to improve the heat insulating performance of the door guide frame, the door guide frame of the detachable and detachable segment structure for sliding windows is divided into an outer main body portion, an main inner body portion, and a heat bridge blocking member between thereof.

In addition, in achieving the above-mentioned technical problems, it is desired to simultaneously improve the heat insulating performance of the entire sliding window system and also provide a technical means for installing an additional insect-proof window.

Technical Solution

In order to solve the above-described problems, the present invention provides door guide frame of the segmented structure for sliding windows and doors; in the door guide frame, a pocket guide being detachably attached to a main body portion of the door guide frame, wherein the pocket guide which is laterally guided and supported on both an inner side and an outer side of the sliding window is detachably installed on the main body portion of the door guide frame; the pocket guide is formed as a plurality of pocket guide segments that is detachable from the main body portion of the door guide frame; and the pocket guide segments are mutually removably installed on both the inner side and outer side of the sliding window along a traveling direction of a roller guide rail;

wherein, in the door guide frame of a separable and detachable segment structure for sliding windows and doors, in which the door guide frame is divided into an outer main body portion and an inner main body portion, a thermal bridge blocking member is disposed between the outer main body portion and the inner main body portion, a second pocket guide segment being received in an outer surface of the inner main body portion and a third pocket guide segment being received in an inner surface of the outer main body portion are formed to have a lower leg region formed of a heat bridge blocking material and separated from an upper cap region of aluminum material;

the door guide frame of a separable and detachable segment structure comprising; in order to improve heat insulation performance of the door guide frame, an external heat bridge blocking member, an external side surface of which is coupled to an inner side surface of the outer main body portion, and an internal heat bridge blocking member, an inner side surface of which is coupled to an external side surface of the inner main body portion; and an intermediate connector of aluminum material having two side surfaces, each of side surfaces being joined to an inner side surface of the external heat bridge blocking member and to an external side surface of the internal heat bridge blocking member;

and wherein, the door guide frame of a separable and detachable segment structure being characterized in that, in order to support two lower leg regions formed by heat bridge blocking material, of the second pocket guide segment received in an outer surface of the inner main body portion and the third pocket guide segment received in an inner surface of the outer main body portion, a separation support region is formed in an upper surface of the intermediate connector.

In addition, a vertical guide frame is provided in a vertical direction on side surface of the main body portion of the door guide frame constituting the door guide frame, and the vertical guide frame is divided into an outer vertical guide frame and an inner vertical guide frame. Additionally it is possible to provide a structure in which the outer heat bridge blocking member (the outer heat bridge blocker), the connector, and the inner heat bridge blocking member (the inner heat bridge blocker) are arranged and connected between thereof. Furthermore, an insect-proof window installation frame is additionally provided on an outer front surface of the door guide frame, and an extended outer surface extending outwardly from the outer main body portion forming the guide frame main body portion of the door guide frame, and therefore a fastening groove for the insect-proof window installation frame may be provided on at least one outer surface of an outer surface of the outer vertical guide frame of the vertical guide frame and a extended outer surface extended from an outer surface of the outer main body forming the main body portion of the door guide frame.

Advantageous Effects

According to the present invention, the second pocket guide segment accommodated in the outer surface of the inner main body portion and the third pocket guide segment accommodated in the inner surface of the outer main body portion are separated from the upper cap region of the aluminum material, and the intermediate connector in which the separator for separating and supporting the lower leg region formed of the heat bridge blocking member is formed without damaging the heat insulating performance of the door guide frame is provided between the external heat bridge blocking member and the internal heat bridge blocking member so that it is possible to provide a good supporting force.

In addition, it is also intended to simultaneously provide an improvement in the heat insulation performance of the entire sliding window system and also provide a technical means for installing an insect-proof window.

MODE FOR CARRYING OUT THE INVENTION

Hereinafter, embodiments of the present invention will be described with reference to the accompanying drawings such that a person ordinarily skilled in the art to which the present invention belongs may easily embody the present invention. However, the present invention may be implemented in various forms and is not limited to the embodiments described herein.

Figure 1:
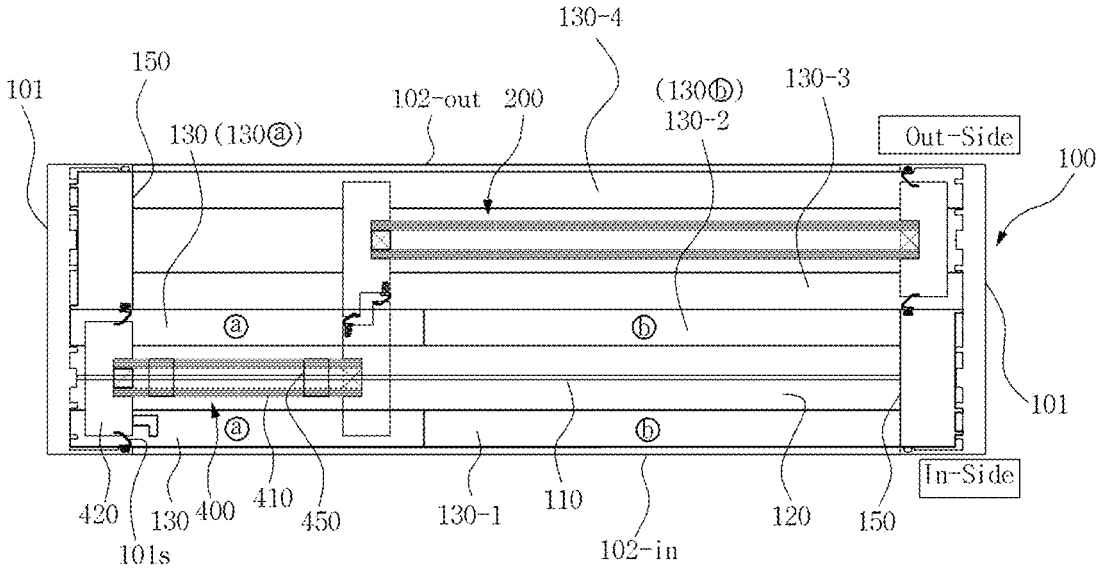
FIGS. 1 to 4 are cross-sectional views of an operating state of a sliding window installation structure including a door guide frame of a segment structure detachable and detachable according to the related art to which the present invention is applied.
Figure 2:
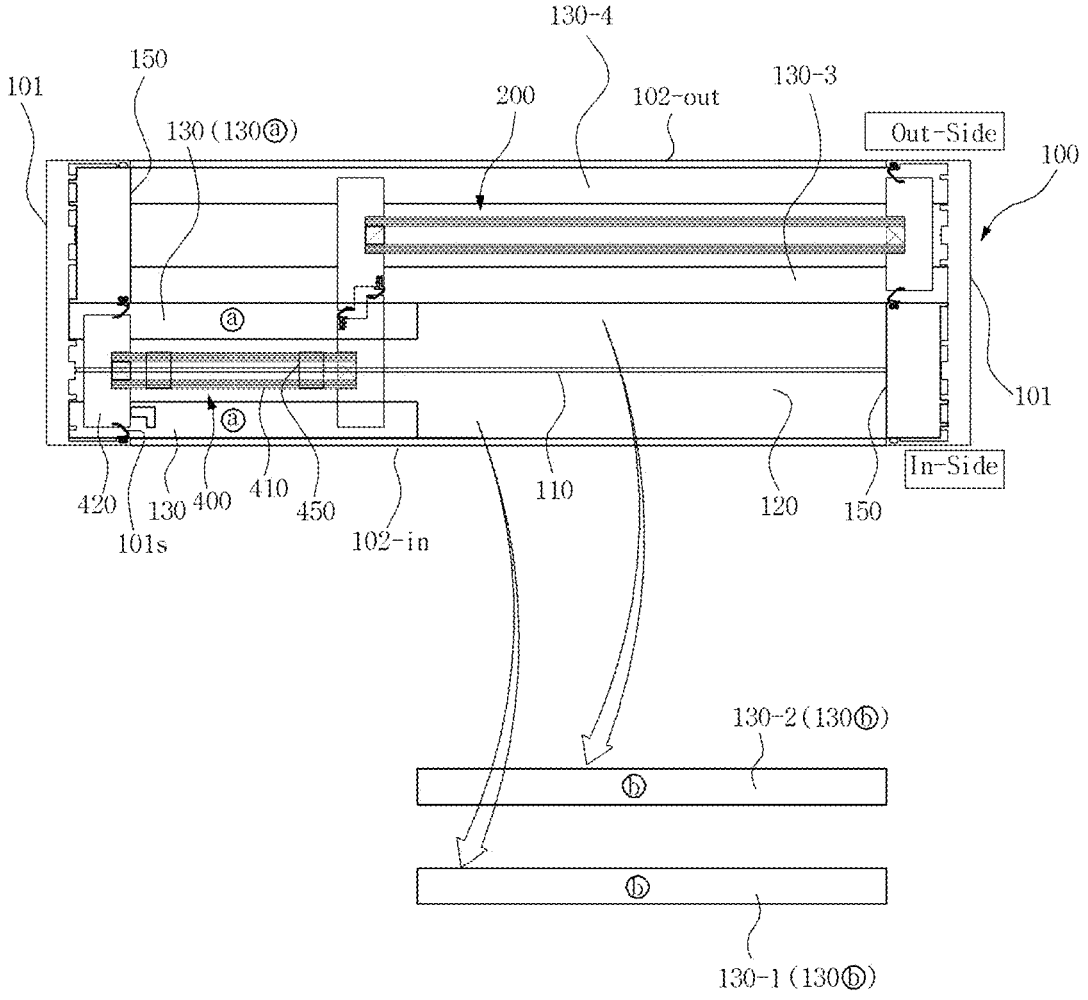
Figure 3:
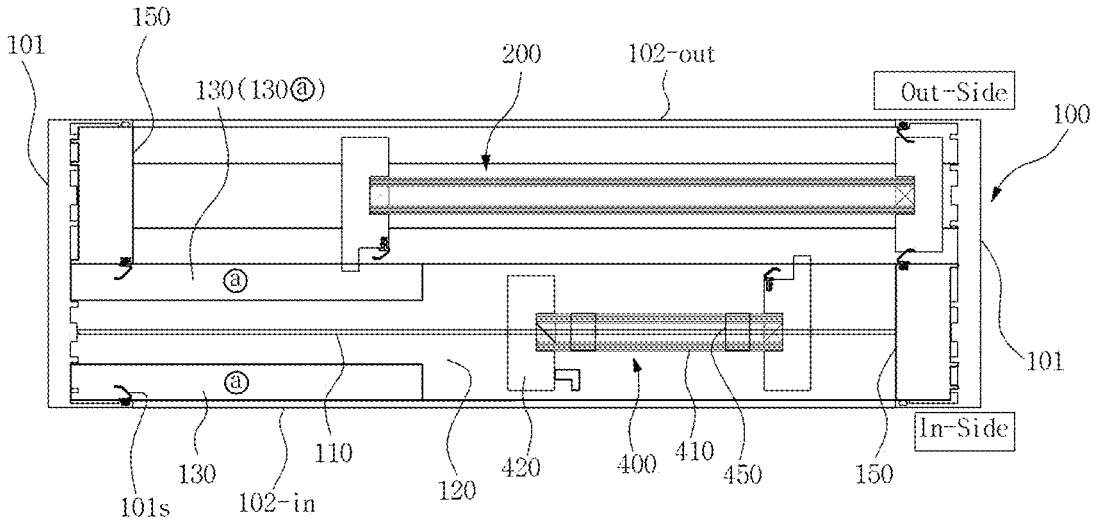
Figure 4:
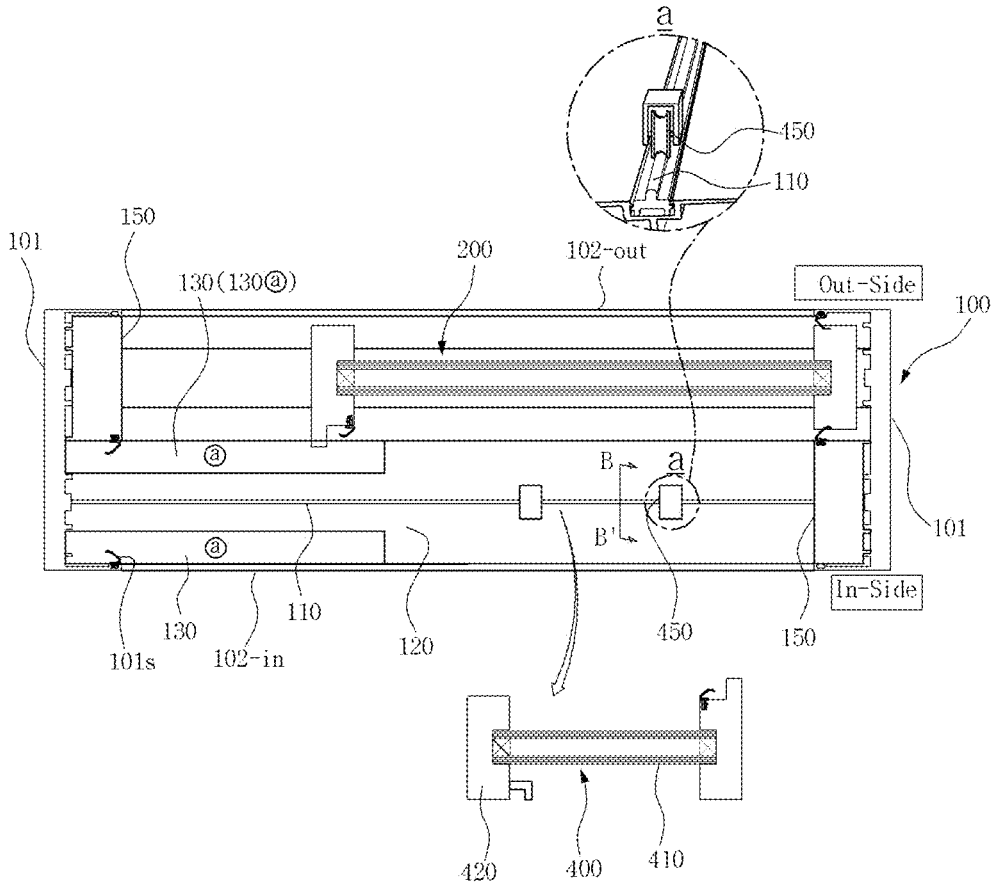
Figure 5:
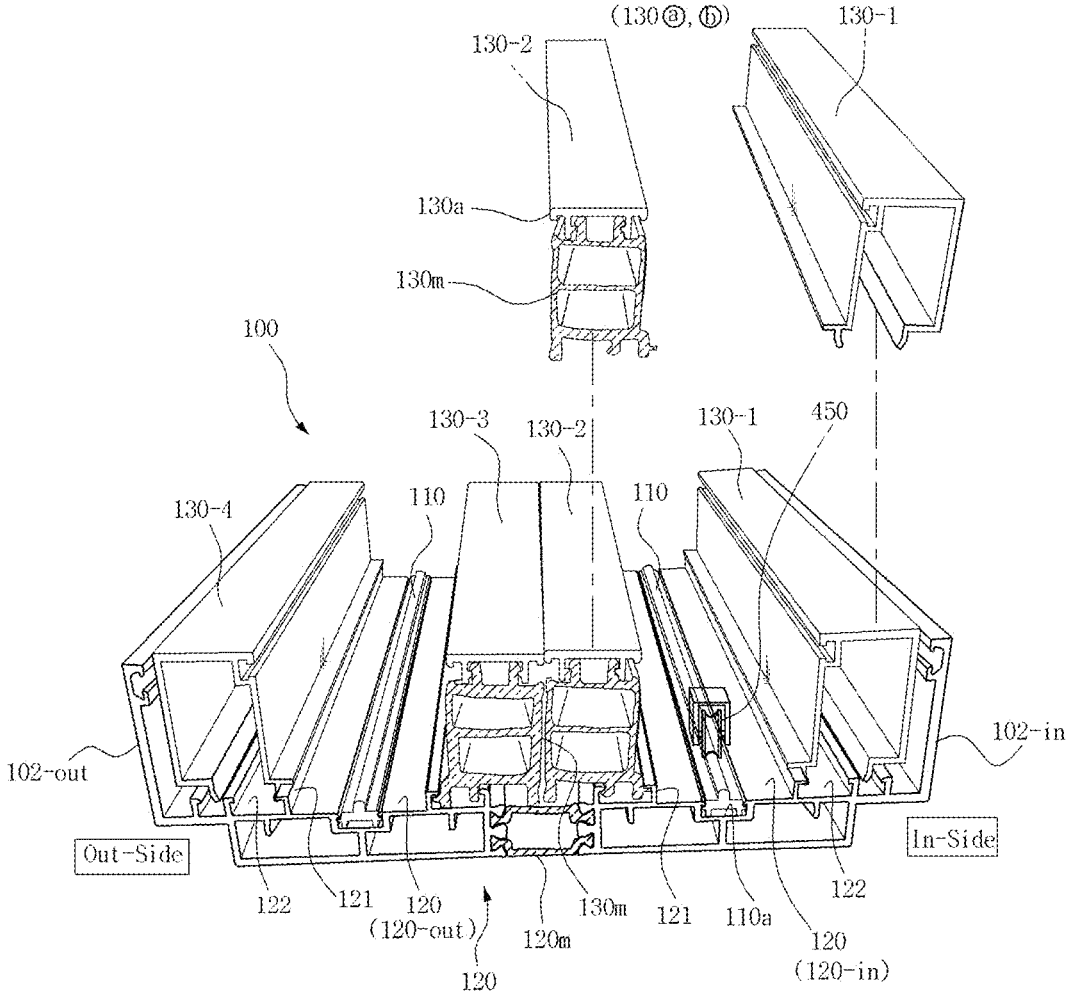
FIG. 5 is a partially exploded perspective view of the position of a broken line taken along line B-B' in FIG. 4, and is a perspective view showing an embodiment in which a sliding window installation structure is applied to an aluminum window frame system.
Figure 6:
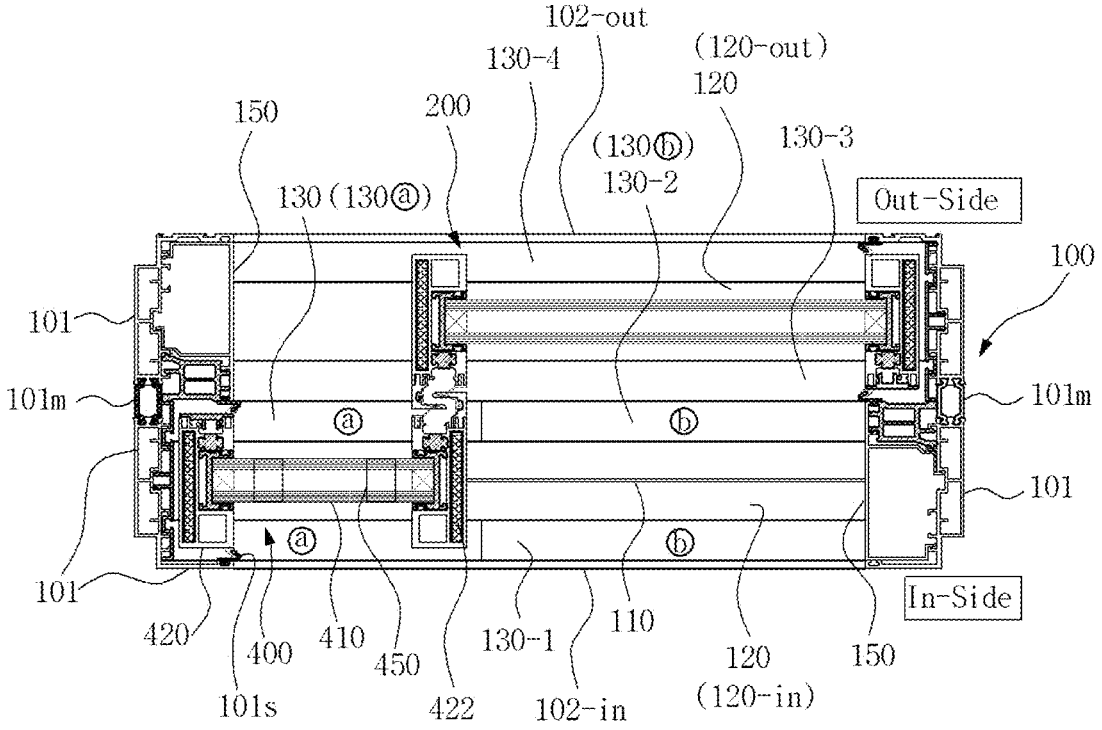
FIG. 6 is a cross-sectional view illustrating an application example in which the structure shown in FIG. 1 to FIG. 4 and FIG. 5.
Figure 7:
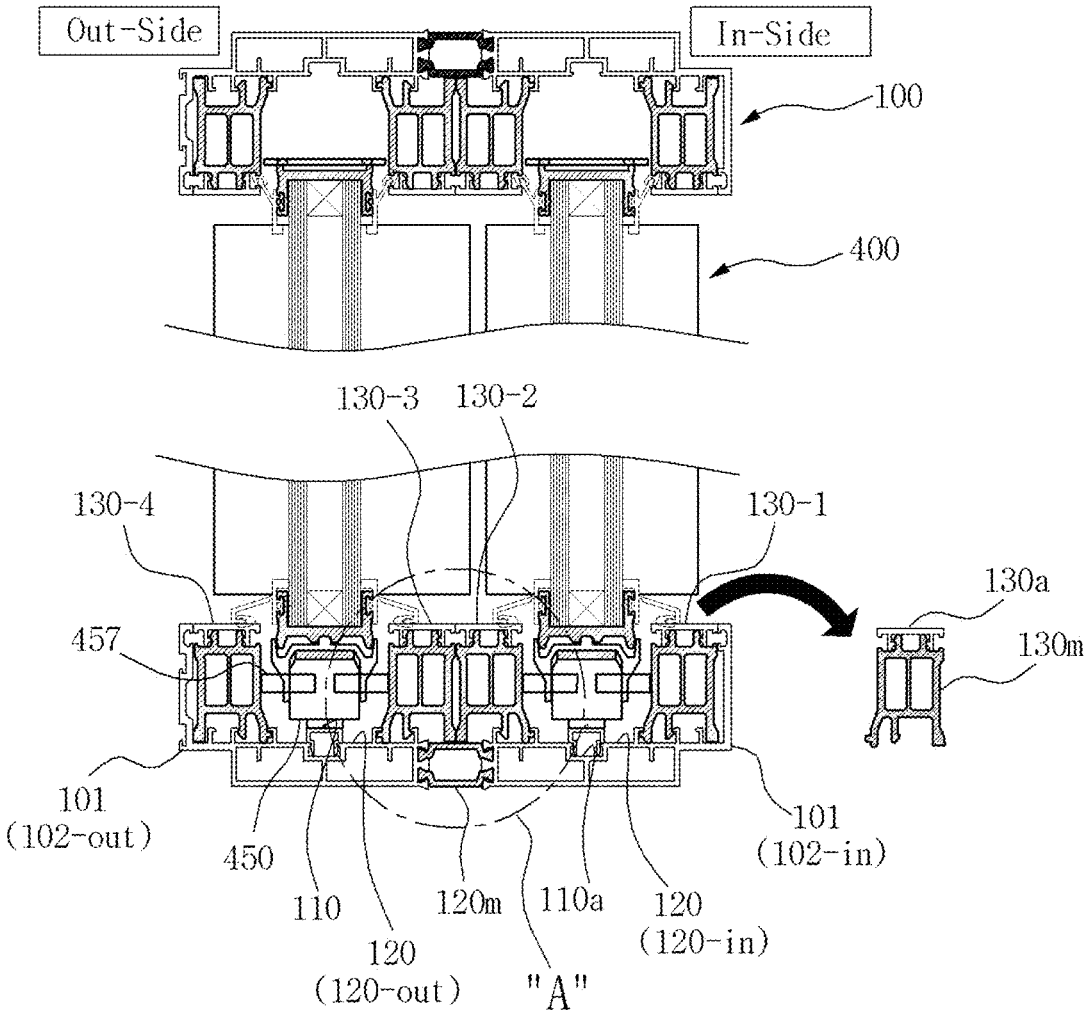
FIG. 7 is a longitudinal sectional view of FIG. 6.
Figure 8:
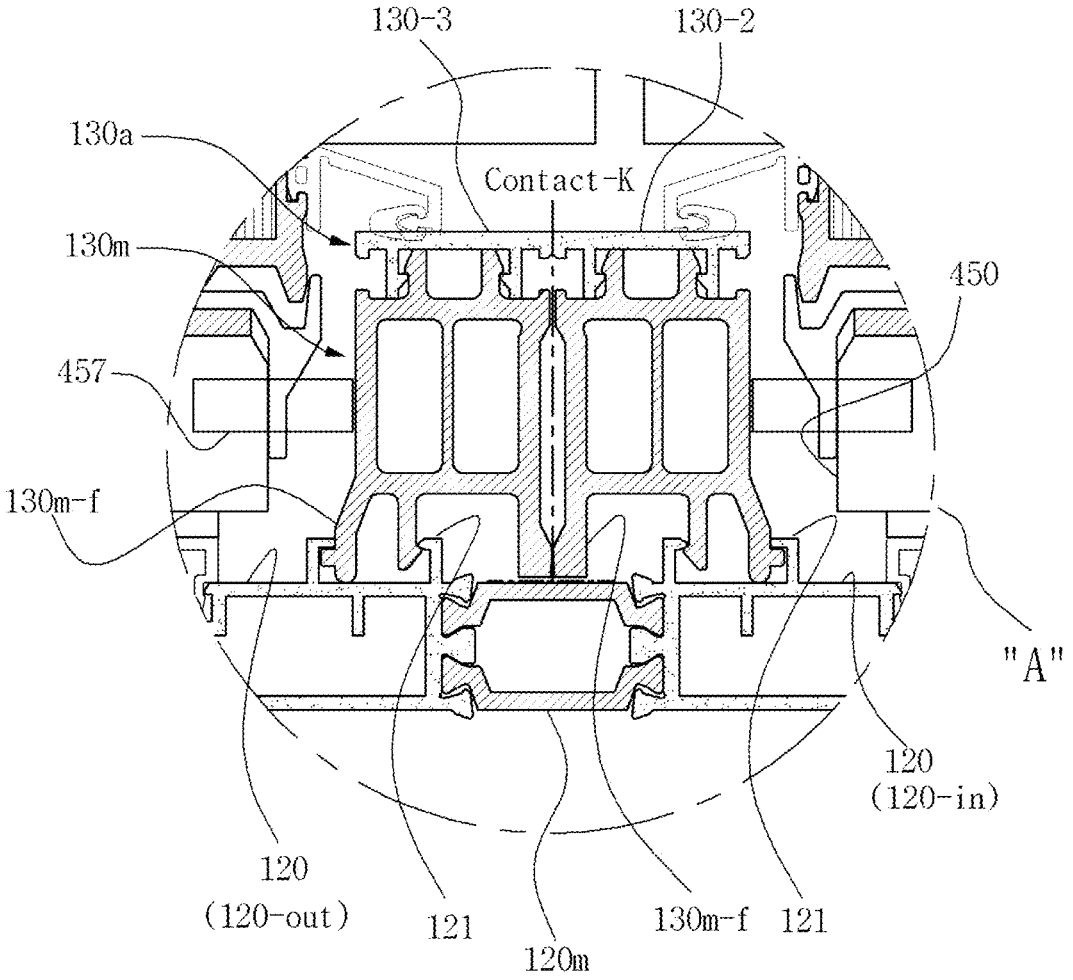
FIG. 8 is an enlarged view of a portion "A" of FIG. 7.
Figure 9:
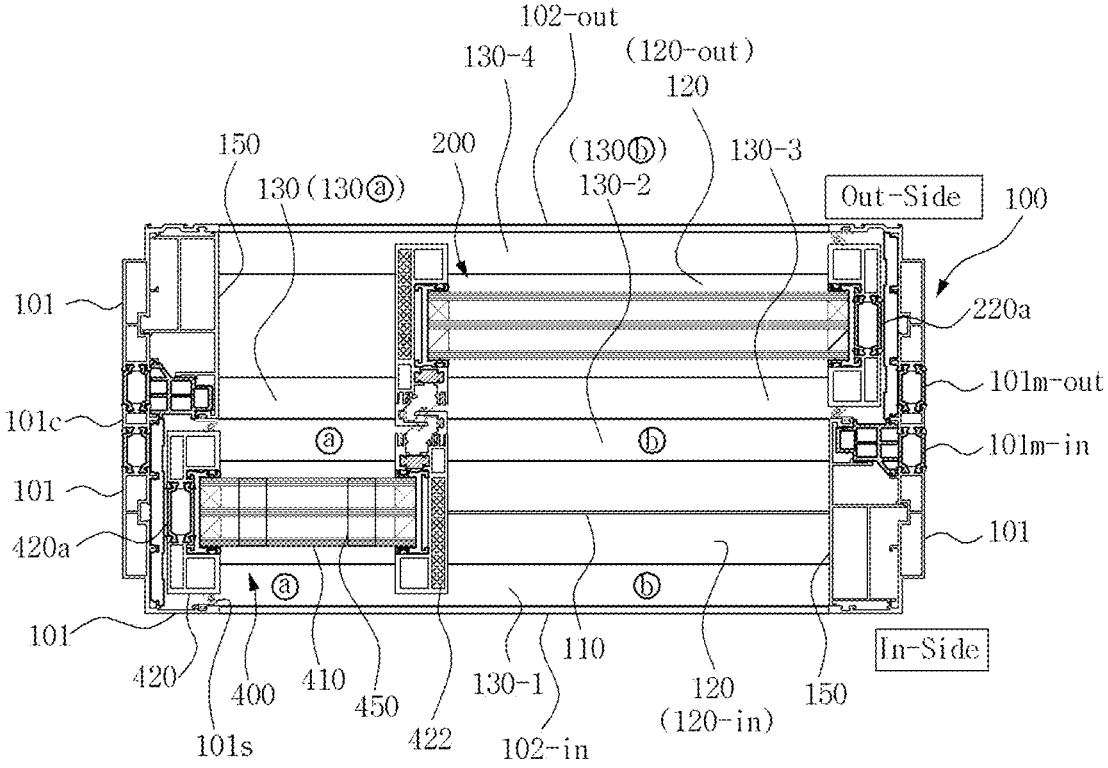
FIG. 9 is a cross-sectional view of a sliding window installation structure having a door guide frame of a separable and detachable segment structure according to a preferred embodiment of the present invention.
Figure 10:
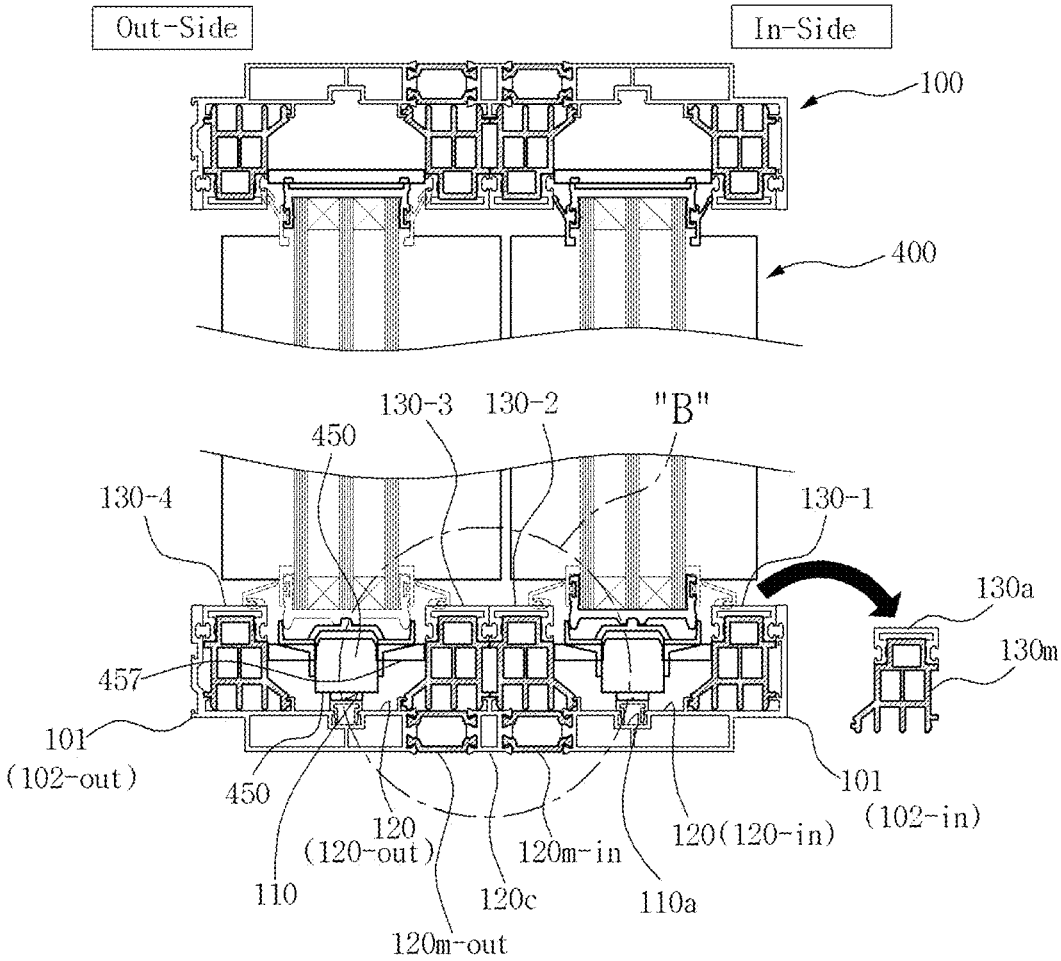
FIG. 10 is a longitudinal sectional view of the embodiment shown in FIG. 9.
Figure 11:
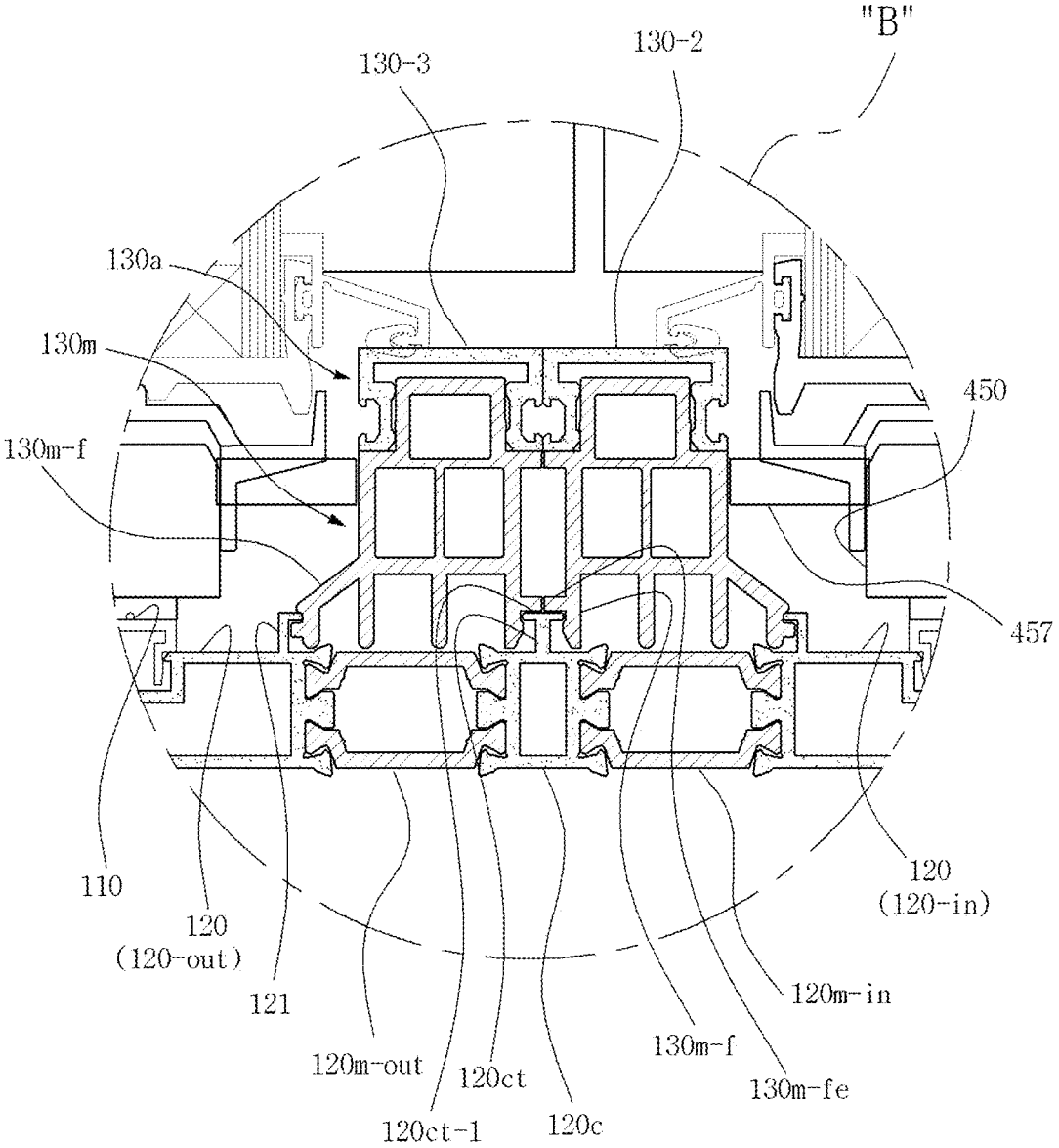
FIG. 11 is an enlarged view of a portion "B" in FIG. 10.

As described above, the present invention is intended to solve a problem of the prior art, FIGS. 9, 10, and 11 are cross-sectional views of an installation state of a preferred embodiment of a sliding window installation structure (a sliding window installation structure including a door guide frame of a separable and detachable segment structure) according to the basic concept of the present invention are shown, and according to a preferred embodiment of the present invention illustrated through these figures, As shown in FIG. 9, in the door guide frame 100, a pocket guide 130 being detachably attached to a main body portion 120 of the door guide frame 100, wherein the pocket guide 130 which is laterally guided and supported on both an inner side and an outer side of the sliding window is detachably installed on the main body portion 120 of the door guide frame 100; the pocket guide 130 is formed as a plurality of pocket guide segments 130ⓐ, 130ⓑ that are detachable from the main body portion 120 of the door guide frame 100; and the pocket guide segments 130ⓐ, 130ⓑ are mutually removably installed on both the inner side and the outer side of the sliding window along a traveling direction of a roller guide rail 110;

wherein, in the door guide frame 100 of a separable and detachable segment structure for sliding windows and doors, in which the door guide frame 100 is divided into an outer main body portion 120-out and an inner main body portion 120-in, a thermal bridge blocking member 120*m* is disposed between the outer main body portion and the inner main body portion, a second pocket guide segment 130-2 being received in an outer surface of the inner main body portion 120-in and a third pocket guide segment 130-3 being received in an inner surface of the outer main body portion 120-out are formed to have a lower leg region 130*m* formed of a heat bridge blocking material and separated from an upper cap region 130*a* of aluminum material;

the door guide frame 100 of a separable and detachable segment structure comprising; in order to improve heat insulation performance of the door guide frame, an external heat bridge blocking member 120*m*-out, an external side surface of which is coupled to an inner side surface of the outer main body portion 120-out, and an internal heat bridge blocking member 120*m*-in, an inner side surface of which is coupled to an external side surface of the inner main body portion 120-in; and an intermediate connector 120*c* of aluminum material having two side surfaces, each of side surfaces being joined to an inner side surface of the external heat bridge blocking member 120*m*-out and to an external side surface of the internal heat bridge blocking member 120*m*-in;

and wherein, the door guide frame of a separable and detachable segment structure being characterized in that, in order to support two lower leg regions 130*m-f* formed by heat bridge blocking material, of the second pocket guide segment 130-2 received in an outer surface of the inner main body portion 120-in and the third pocket guide segment 130-3 received in an inner surface of the outer main body portion 120-out, a separation support region 120*ct* is formed in an upper surface of the intermediate connector 120*c*.

Here, as shown in an enlarged view of FIG. 11, it is preferable that the separation supporting region 120*ct* is formed integrally upwardly from an upper surface of the intermediate connector 120*c* and an upper supporting part 120*ct*-1 of the separation supporting region 120*ct* is formed wider than a protruding part under the upper supporting part 120*ct*-1. Also, it is preferable that on the upper supporting part 120*ct*-1 of the separation supporting region 120*ct*, seating projections 130*m-fe* protruding laterally from the lower leg region 130*m-f* formed of heat bridge blocking material of the second pocket guide segment 130-2 and the third pocket guide segment 130-2 are seated and supported while facing each other.

Meanwhile, according to a more preferred embodiment of the present invention, as shown in FIG. 9, a vertical guide frame 101 installed vertically on side surface of the main body portion 120 constituting the door guide frame 100 is divided into an outer vertical guide frame and an inner vertical guide frame, it is preferable to arrange and connect an outer side heat bridge blocking member 101*m*-out, a connector 101*c*, and an inner side heat bridge blocking member 101*m*-in between the outer vertical guide frame and the inner vertical guide frame, therefore the outer side heat bridge blocking member 101*m*-out, the connector 101*c*, and the inner side heat bridge blocking member 101*m*-in are respectively connected to the external heat bridge blocking member 120*m*-out of the main body portion 120 of the door guide frame, the intermediate connector 120*c*, and the internal heat bridge blocking member 120*m*-in, so as to improve the heat insulation performance of the entire sliding window system.

Figure 12:
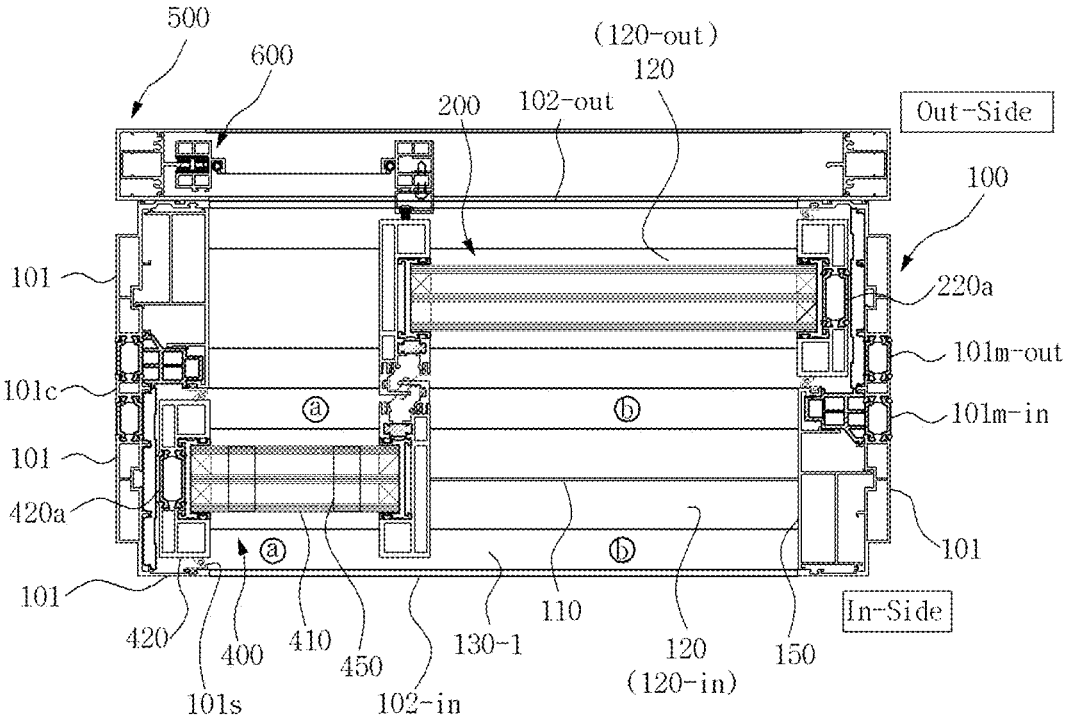
FIG. 12 is a cross-sectional view illustrating a state in which an insect-proof window installation frame including a sliding insect-proof window is additionally installed in the embodiment shown in FIG. 9.
Figure 13:
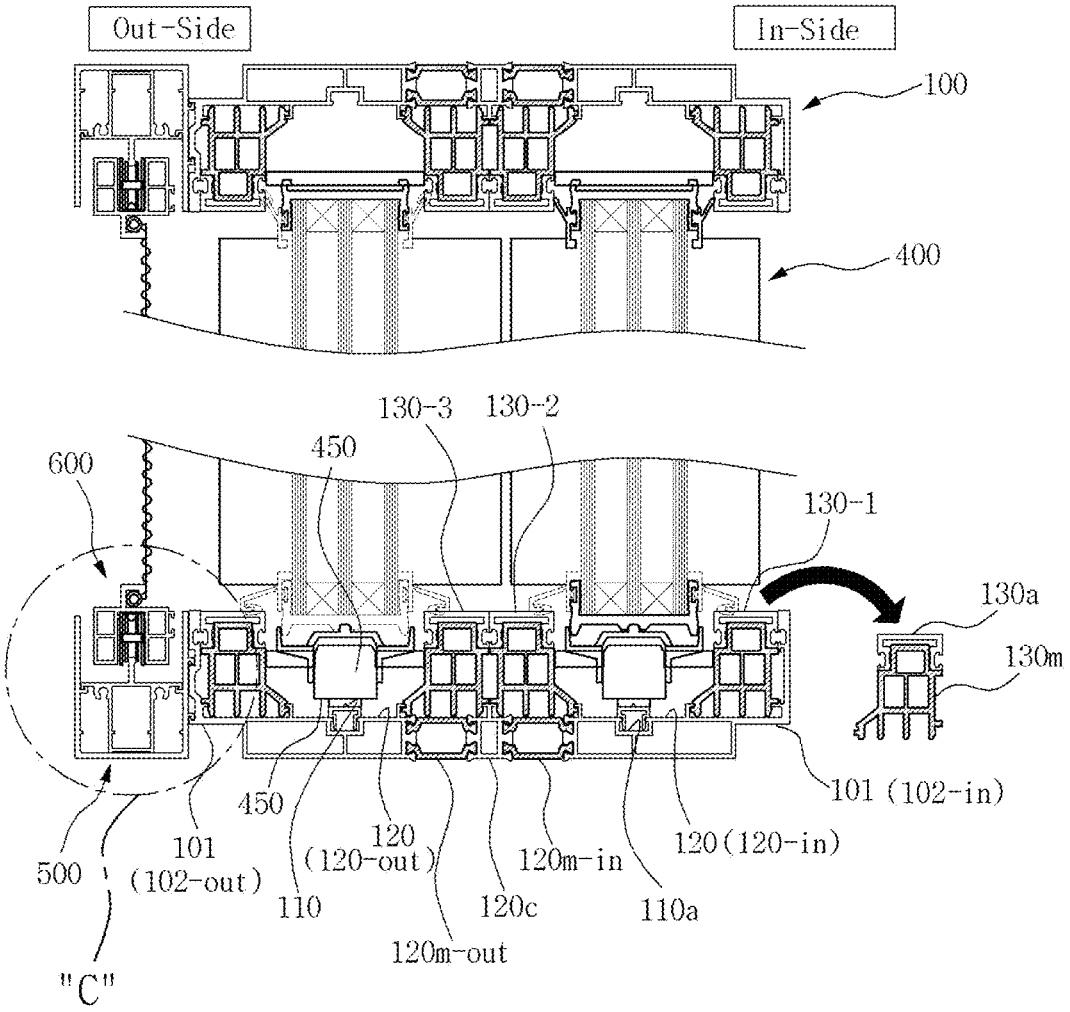
FIG. 13 is a longitudinal section of a further embodiment shown in FIG. 12.
Figure 14:
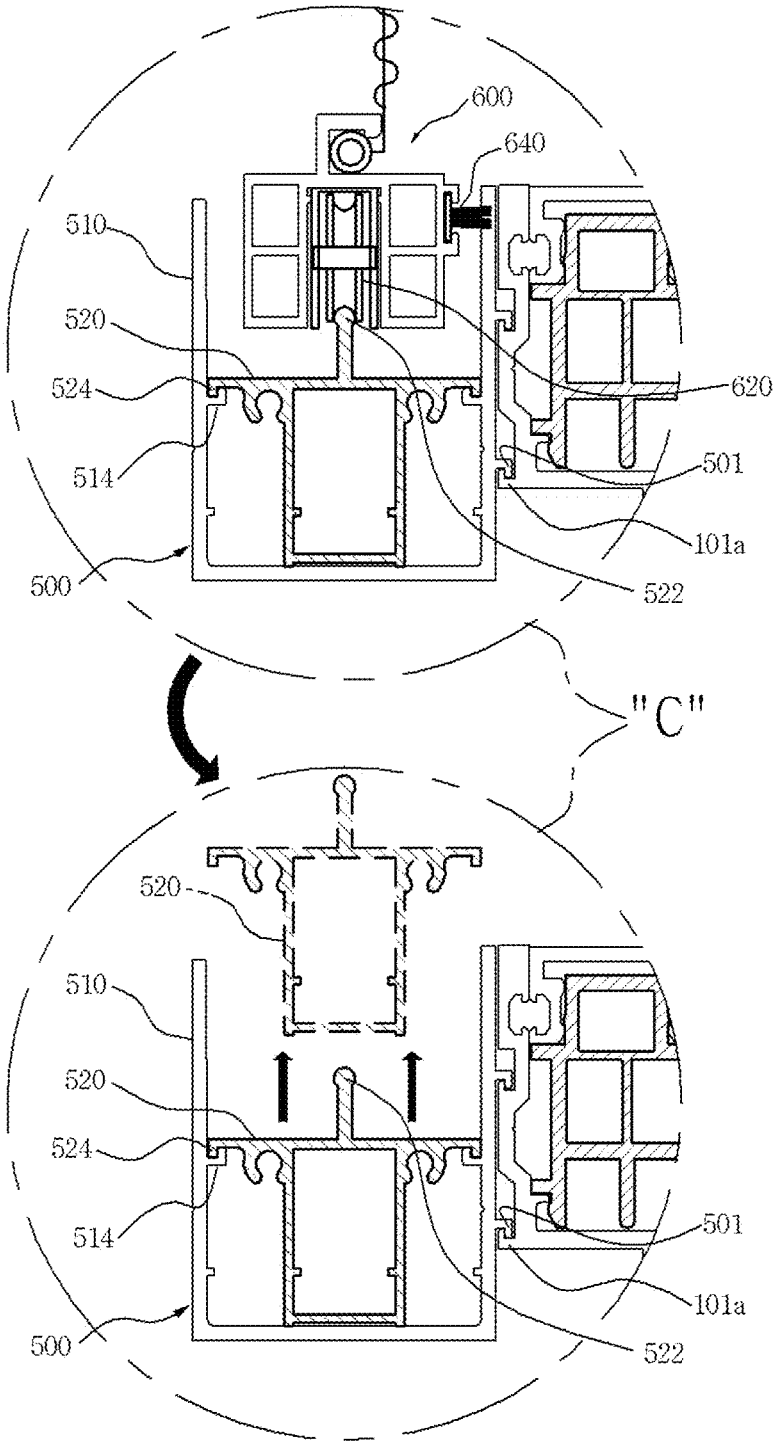
FIG. 14 is an enlarged view of a portion "C" in FIG. 13.

In addition, according to a further preferred embodiment of the present invention, as shown in FIGS. 12 to 14, in order to additionally provide an insect-proof window installation structure in the sliding window system, at an outer front surface of the door guide frame 100, an insect-proof window installation frame 500 is additionally provided, in order to allow a sliding insect-proof window 600 to be integrally installed into the insect-proof window installation frame 500 and to be able to separate the sliding insect-proof window 600 from the insect-proof window installation frame 500, wherein the insect-proof window installation frame 500 comprises;

an insect-proof screen mounting frame main body pocket 510 installed at the outer front surface of the door guide frame 100;

a rail 522 extending along the sliding movement direction of the sliding insect-proof window 500 at a position having a predetermined distance from the bottom surface or the ceiling of the insect-proof screen mounting frame main body pocket 510; and a rail bridge 520 detachably inserted into the insect-proof screen mounting frame main body pocket 510.

Further, a fastening groove 101*a* for the insect-proof window installation frame may be provided on at least one of an outer surface of the outer vertical guide frame of the vertical guide frame 101 and a extended outer surface 102-out extended from an outer surface of the outer main body portion 120-out forming the main body portion 120 of the door guide frame 100, and that a fastening protrusion 501 being engaged with the fastening groove 101*a* is protruded from the insect-proof screen mounting frame main body pocket 510.

As shown in FIG. 14, an inner side of the insect-proof screen mounting frame main body pocket 510 is preferably provided with a latching end 514 protruding and formed along a traveling direction of the rail 522. At both inner and outer ends of the rail bridge 520, it is preferable that an engagement protrusion 524 which is fitted to the latching end 514 is provided along the traveling direction of the rail 522. The rail bridge 520 is prevented from separating from the insect-proof screen mounting frame main body pocket 510 unless a predetermined frictional force is generated and an external force is applied at a portion where the latching end 514 and the engagement protrusion 524 are engaged, it is preferable that the rail 522 is protruded from the upper surface of the rail bridge 520 and is easily detached and separated when the rail 522 is gripped and pulled.

The rail bridge 520 may be formed of two or more rail bridge segments detachable from the inside of the insect-proof screen mounting frame main body pocket 510.

It should be understood by those skilled in the art that a single window 200 other than the sliding window 400 is illustrated in the form of a fixed window in the drawings, but may be a sliding window other than a fixed window within the scope of the present invention. It will be obvious.

According to the basic concept of the present invention, the pocket guide segments 130ⓐ and 130ⓑ supporting the sliding window 400 can be removed from the door guide frame 100, separation from the door guide frame 100 or installation on the door guide frame 100 may be performed, which process is substantially the same as the process outlined in FIGS. 1 to 4 of the accompanying drawings. The entire structure and operation of the present invention are described in Korean Patent Application No. 10-2012-0047789 (Korean Patent Registration No. 10-1367835) filed by the inventor of the present invention and PCT Application No. PCT/KR2013/003912 published in a laid-open Publication No. WO 2013/168943A1), which is incorporated herein by reference in its entirety.

However, the scope of the present invention to be protected is not limited thereto and may cover various types of sliding windows (door or window) to which the present invention is applied, and various modifications and changes using the basic concept of the present invention defined in the accompanying claims also belong to the scope of the present invention.

The invention claimed is:

1. A door guide frame of detachable segment structure for sliding windows and doors, in the door guide frame 100, a pocket guide 130 being detachably attached to a main body portion 120 of the door guide frame 100, wherein the pocket guide 130 which is laterally guided and supported on both an inner side and an outer side of the sliding window is detachably installed on the main body portion 120 of the door guide frame 100; the pocket guide 130 is formed as a plurality of pocket guide segments 130ⓐ, 130ⓑ that are detachable from the main body portion 120 of the door guide frame 100; and the pocket guide segments 130ⓐ, 130ⓑ are mutually removably installed on both the inner side and the outer side of the sliding window along a traveling direction of a roller guide rail 110;

wherein, in the door guide frame 100 of a separable and detachable segment structure for sliding windows and doors, in which the door guide frame 100 is divided into an outer main body portion 120-out and an inner main body portion 120-in, a thermal bridge blocking member 120*m* is disposed between the outer main body portion and the inner main body portion, a second pocket guide segment 130-2 being received in an outer surface of the inner main body portion 120-in and a third pocket guide segment 130-3 being received in an inner surface of the outer main body portion 120-out are formed to have a lower leg region 130*m* formed of a heat bridge blocking material and separated from an upper cap region 130*a* of aluminum material;

the door guide frame 100 of a separable and detachable segment structure comprising; in order to improve heat insulation performance of the door guide frame, an external heat bridge blocking member 120*m*-out, an external side surface of which is coupled to an inner side surface of the outer main body portion 120-out, and an internal heat bridge blocking member 120*m*-in, an inner side surface of which is coupled to an external side surface of the inner main body portion 120-in; and an intermediate connector 120*c* of aluminum material having two side surfaces, each of side surfaces being joined to an inner side surface of the external heat bridge blocking member 120*m*-out and to an external side surface of the internal heat bridge blocking member 120*m*-in;

and wherein, the door guide frame of a separable and detachable segment structure being characterized in that, in order to support two lower leg regions 130*m-f* formed by heat bridge blocking material, of the second pocket guide segment 130-2 received in an outer surface of the inner main body portion 120-in and the third pocket guide segment 130-3 received in an inner surface of the outer main body portion 120-out, a separation support region 120*ct* is formed in an upper surface of the intermediate connector 120*c*.

2. The door guide frame of detachable segment structure for sliding windows and doors of claim 1, characterized in that the separation supporting region 120*ct* is formed integrally upwardly from an upper surface of the intermediate connector 120*c* and an upper supporting part 120*ct*-1 of the separation supporting region 120*ct* is formed wider than a protruding part under the upper supporting part 120*ct*-1.

3. The door guide frame of detachable segment structure for sliding windows and doors of claim 2, characterized in that on the upper supporting part 120*ct*-1 of the separation supporting region 120*ct*, seating projections 130*m-fe* protruding laterally from the lower leg region 130*m-f* formed of heat bridge blocking material of the second pocket guide segment 130-2 and the third pocket guide segment 130-2 are seated and supported while facing each other.

4. The door guide frame of detachable segment structure for sliding windows and doors of claim 3, characterized in that a vertical guide frame 101 installed vertically on side surface of the main body portion 120 constituting the door guide frame 100 is divided into an outer vertical guide frame and an inner vertical guide frame, and an outer side heat bridge blocking member 101*m*-out, a connector 101*c*, and an inner side heat bridge blocking member 101*m*-in between the outer vertical guide frame and the inner vertical guide frame are arranged, and the outer side heat bridge blocking member 101*m*-out, the connector 101*c*, and the inner side heat bridge blocking member 101*m*-in are respectively connected to the external heat bridge blocking member 120*m*-out of the main body portion 120 of the door guide frame 100, the intermediate connector 120*c*, and the internal heat bridge blocking member 120*m*-in.

5. The door guide frame of detachable segment structure for sliding windows and doors of claim 4, characterized in that in order to additionally provide an insect-proof window installation structure in the sliding window system, at an outer front surface of the door guide frame 100, an insect-proof window installation frame 500 is additionally provided, in order to allow a sliding insect-proof window 600 to be integrally installed into the insect-proof window installation frame 500 and to be able to separate the sliding insect-proof window 600 from the insect-proof window installation frame 500, wherein the insect-proof window installation frame 500 comprises;

an insect-proof screen mounting frame main body pocket 510 installed at the outer front surface of the door guide frame 100;

a rail 522 extending along the sliding movement direction of the sliding insect-proof window 500 at a position having a predetermined distance from the bottom surface or the ceiling of the insect-proof screen mounting frame main body pocket 510; and a rail bridge 520 detachably inserted into the insect-proof screen mounting frame main body pocket 510; and a fastening groove 101*a* for the insect-proof window installation frame is provided on at least one of an outer surface of the outer vertical guide frame of the vertical guide frame 101 and a extended outer surface 102-out extended from an outer surface of the outer main body portion 120-out forming the main body portion 120 of the door guide frame 100, and that a fastening protrusion 501 being engaged with the fastening groove 101*a* is protruded from the insect-proof screen mounting frame main body pocket 510.

* * * * *